US005600855A

United States Patent [19]

Ramirez

[11] Patent Number: 5,600,855

[45] Date of Patent: Feb. 11, 1997

[54] DECORATIVE COVER FOR THE ADJUSTING STRAPS ON A CAP

[76] Inventor: Richard D. Ramirez, 7514 Evans Ford Rd., Clifton, Va. 22024

[21] Appl. No.: 591,260

[22] Filed: Jan. 22, 1996

Related U.S. Application Data

[63] Continuation of Ser. No. 225,710, Apr. 11, 1994, abandoned.

[51] Int. Cl.[6] ..... A42B 1/24

[52] U.S. Cl. ..... 2/209.13; 2/181.4; 2/195.2; 40/329

[58] Field of Search ..... 2/181, 181.2, 181.4, 2/181.6, 195.1, 195.2, 195.3, 195.4, 209.13, 274, 275; 24/580; 40/329, 586, 604, 617; 150/154; 294/138, 149, 152, 156; 383/87; D11/200, 213, 214, 215; D19/56

[56] References Cited

U.S. PATENT DOCUMENTS

| | | | |
|---|---|---|---|
| 1,191,707 | 7/1916 | Kimmel | 2/274 |
| 1,294,595 | 2/1919 | Allen . | |
| 2,181,446 | 11/1939 | Ames . | |
| 2,263,651 | 11/1941 | Silberman | 2/274 |
| 3,280,406 | 10/1966 | Immel . | |
| 4,468,817 | 9/1984 | Nunnery et al. . | |
| 4,872,218 | 10/1989 | Holt . | |
| 4,905,406 | 3/1990 | Warner . | |
| 5,003,639 | 4/1991 | White | 2/209.13 |
| 5,003,640 | 4/1991 | Pizzacar . | |
| 5,161,259 | 11/1992 | Shorts . | |
| 5,282,278 | 2/1994 | Miner . | |
| 5,287,559 | 2/1994 | Christiansen et al. . | |

FOREIGN PATENT DOCUMENTS

| | | |
|---|---|---|
| 444667 | 3/1936 | United Kingdom . |

*Primary Examiner*—Diana Biefeld
*Attorney, Agent, or Firm*—Dennis H. Lambert

[57] ABSTRACT

A decorative cover for the adjusting straps on a cap of the type having overlapping adjusting straps in the back, wherein the cover is made from a flat sheet of material folded to define looped ends and generally parallel front and back panels. The panels are adapted to be disposed on opposite sides of the adjusting straps with the looped ends disposed in proximity to one another. Removable fasteners are received in the looped ends to retain the folded sheet of material in place on the adjusting straps. Advertising or other promotional material or decorative items may be placed on the front panel. In one form of the invention, the fasteners are bobby-pin-shaped spring clips which are inserted into opposite ends of the looped ends. In another form of the invention, the fasteners are magnets which are received in the looped ends so that the looped ends are held together when they are placed in proximity with one another.

13 Claims, 4 Drawing Sheets

DECORATIVE COVER FOR THE ADJUSTING STRAPS ON A CAP

This application is a Continuation of application Ser. No. 08/225,710, filed Apr. 11, 1994, now abandoned.

TECHNICAL FIELD

This invention relates generally to caps of the type which have overlapping adjusting straps in the back, as, for example, a baseball cap. More specifically, the invention relates to a decorative cover for the straps that not only improves the appearance of the cap, but also improves comfort to the wearer. The cover may be used for advertising, promotion, and the like.

BACKGROUND ART

Caps of the type having adjusting straps in the back, especially the type having a bill in front, generally referred to as baseball caps, are in widespread use. These caps are typically manufactured in only two or three sizes, i.e., either for small children or for adults, with overlapping adjusting straps in the back of the cap for adjusting the cap to fit a variety of sizes in children, or a variety of sizes in adults.

The adjusting straps are typically made of plastic material, with one of the straps having a plurality of small openings through it and the other strap having a corresponding plurality of small pegs or pins which are adapted to snap through the openings to hold the straps in adjusted position. The straps are generally of less width than the headband or sweatband of the cap, and define a slightly larger circumference than the headband of the cap. Consequently, when the cap is worn, the adjusting strap portion does not fit the wearer's head as comfortably as the cap headband, and may tend to ride up the back of the wearer's head. Additionally, the wearer's hair may protrude through the opening that is normally defined in the back of the cap above the adjusting strap.

A variety of devices have been developed in the prior art in an effort to improve the comfort of such caps, and/or to improve their appearance. These devices generally comprise some type of wrap or cover which is applied to the adjusting straps. Some of these prior art devices have included means for substantially concealing the adjusting strap and may incorporate advertising or promotional material. Many of these devices are relatively expensive to make and/or cumbersome to use, however, and because of the means used to secure them in place are susceptible to becoming dislodged and lost.

Accordingly, there is need for a device that can be applied to the adjusting straps on a cap that will not only improve the appearance of the cap, but will also make it more comfortable to wear. Such means should further be capable of displaying advertising, promotional material or other indicia, as desired. Preferably, the device should be economical to make, easy to use and secure in its attachment so it will not be accidentally dislodged.

DISCLOSURE OF THE INVENTION

The present invention provides a simple and inexpensive means for securely and conveniently covering the adjusting straps on a cap, thereby improving the appearance and comfort of the cap, while at the same time providing a convenient means for displaying advertising and/or promotional material or other indicia, as desired.

The cover of the invention comprises a flat, rectangular sheet of material, such as leather, suede or other suitable material, which is folded around the adjusting straps on the back of a cap so that two looped ends are formed, and a spring clip is then inserted into the looped ends to securely hold the cover to the straps.

Alternatively, permanent magnets may be inserted into the looped ends so that when the looped ends are brought into proximity with one another, they are held together to retain the cover in place on the adjusting straps. Further, other types of fastener may be used, such as a barrette-type clip that would be inserted into the looped ends from only one end.

BRIEF DESCRIPTION OF THE DRAWINGS

The foregoing, as well as other objects and advantages of the invention, will become apparent from the following detailed description and accompanying drawings, wherein like reference numerals indicate like parts throughout the several views, and wherein.

BEST MODE OF CARRYING OUT THE INVENTION

Figure 1:
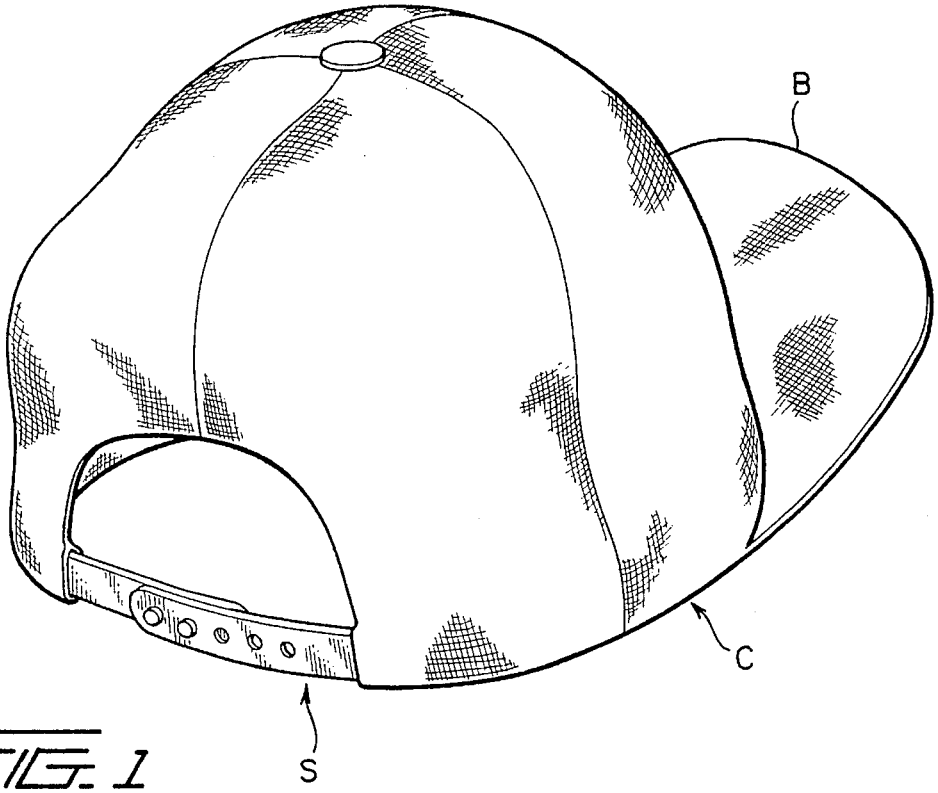
FIG. 1 (PRIOR ART)
FIG. 1 is a rear perspective view of a conventional cap having adjusting straps in the rear.

Referring more particularly to the drawings, a conventional cap C of the type having overlapping adjusting straps S in the back and a bill B in the front is shown in FIG. 1.

Figure 2:
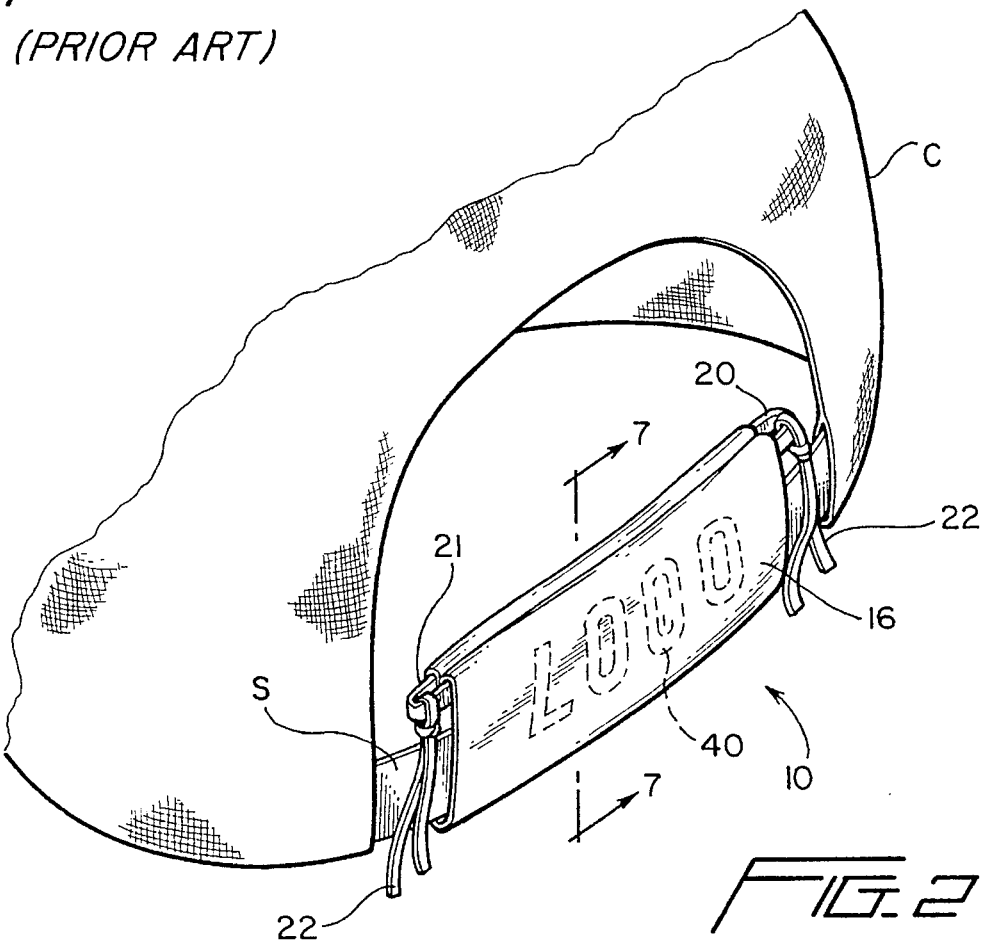
FIG. 2 is an enlarged, fragmentary, rear perspective view of the cap of FIG. 1, with a cover according to the invention applied to the adjusting straps.
Figure 4:
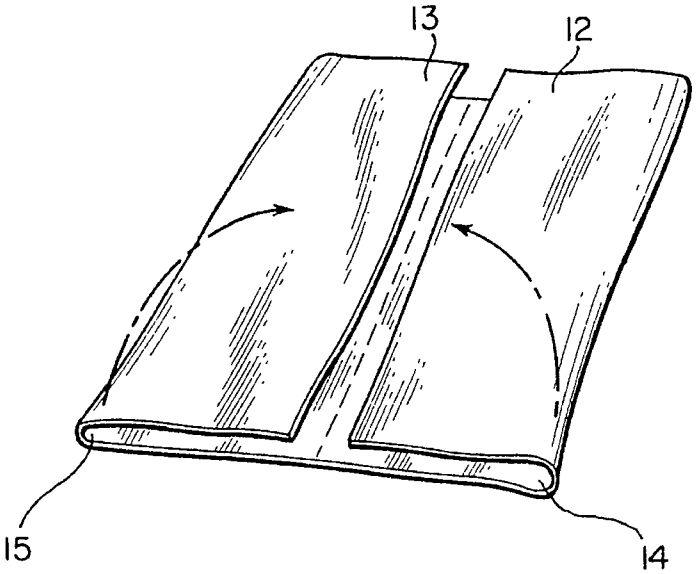
FIG. 4 is a perspective view of the piece of material of FIG. 3, after having been folded once to form the looped ends.
Figure 5:
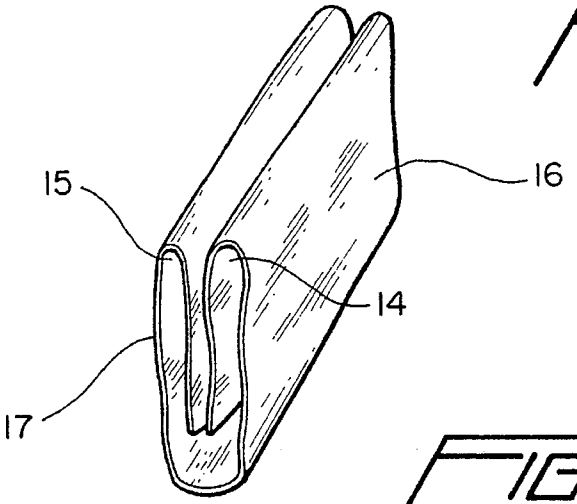
FIG. 5 is a perspective view of the piece of material folded to form the cover and ready to be applied to the adjusting straps on a cap.
Figure 3:
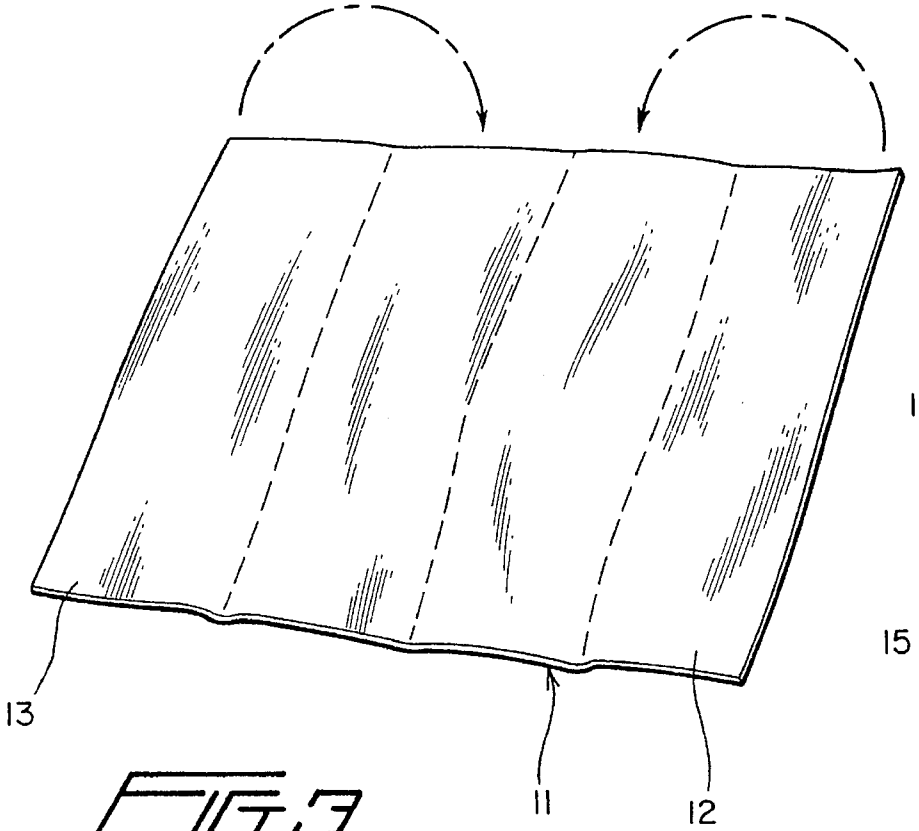
FIG. 3 is a perspective view of a piece of material, such as leather or the like, prior to being folded to form the cover of the invention.

A first form of cover in accordance with the invention is indicated generally at 10 in FIGS. 2–4, and in FIG. 2 is shown applied to the adjusting straps S on the cap.

Figure 6:
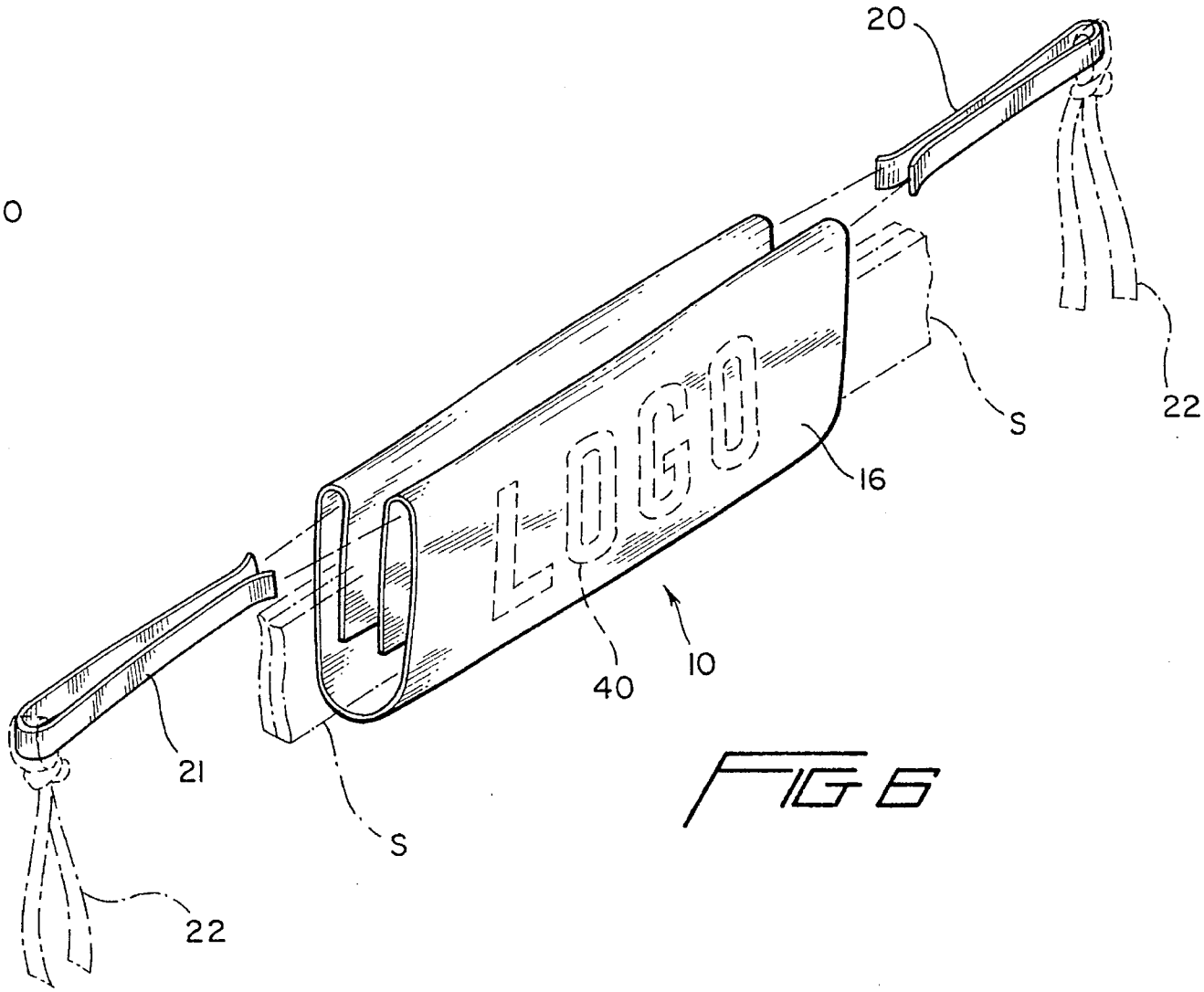
FIG. 6 is a greatly enlarged exploded top perspective view of the cover of the invention, showing the spring clips in position to be inserted into the looped ends, and showing the adjusting straps in dot-and-dashed lines.
Figure 7:
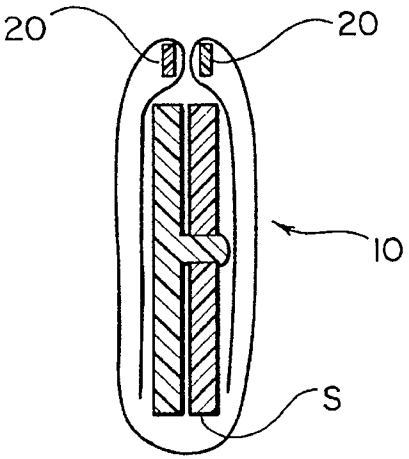
FIG. 7 is an enlarged sectional view of the adjusting straps and cover of the invention, taken along line 7—7 in FIG. 2.

As depicted in FIGS. 3–6, the cover is very simply made from a flat, rectangular sheet 11 of material such as leather or the like. First, opposite side panels 12 and 13 of the sheet are folded upwardly to form looped ends 14 and 15, as shown in FIGS. 3 and 4. The looped ends are then folded upwardly toward each other about the centerline of the sheet into the configuration shown in FIG. 5, defining front and back panels 16 and 17. The folded sheet is then placed upwardly on the adjusting straps S, with the looped ends 14 and 15 lying on opposite sides of the adjusting straps, as shown in FIG. 6. It should be noted that when properly positioned, the looped ends extend slightly above the upper edge of the adjusting straps, and the front panel 16 is centered on and conceals most of the adjusting straps from outside the cap, while the back panel 17 forms a relatively wide area for contacting the back of the head of the wearer. In fact, the width and thickness of that portion of the cover which lies behind the adjusting straps more nearly matches the headband in the cap and makes the cap much more comfortable to wear than a conventional cap as shown in FIG. 1.

With particular reference to FIG. 6, a pair of elongate, U-shaped spring clips 20 and 21 are then inserted into the looped ends to tightly clamp them together over the upper edge of the adjusting straps to securely hold the cover in place, as shown in FIG. 2. The spring clips may be made of spring steel, plastic or other suitable material and should have adequate strength to tightly grip the looped ends. Moreover, decorative means such as tassels or the like 22 may be provided on the closed ends of the spring clips. These tassels not only serve as decorative items, but also define means which may be grasped between the fingers of the user to facilitate removal of the clips from the looped ends when it is desired to remove the cover.

Figure 9:
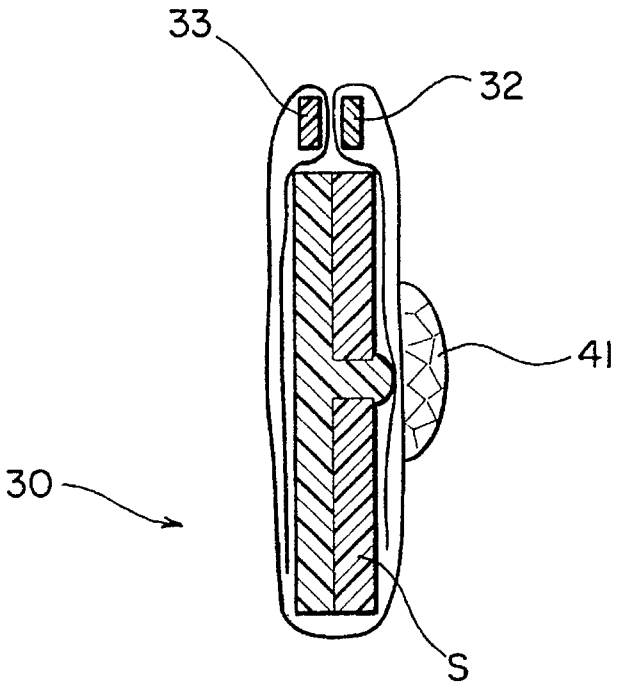
FIG. 9 is an enlarged sectional view of the cover of FIG. 8, taken along line 9—9 in FIG. 8.
Figure 8:
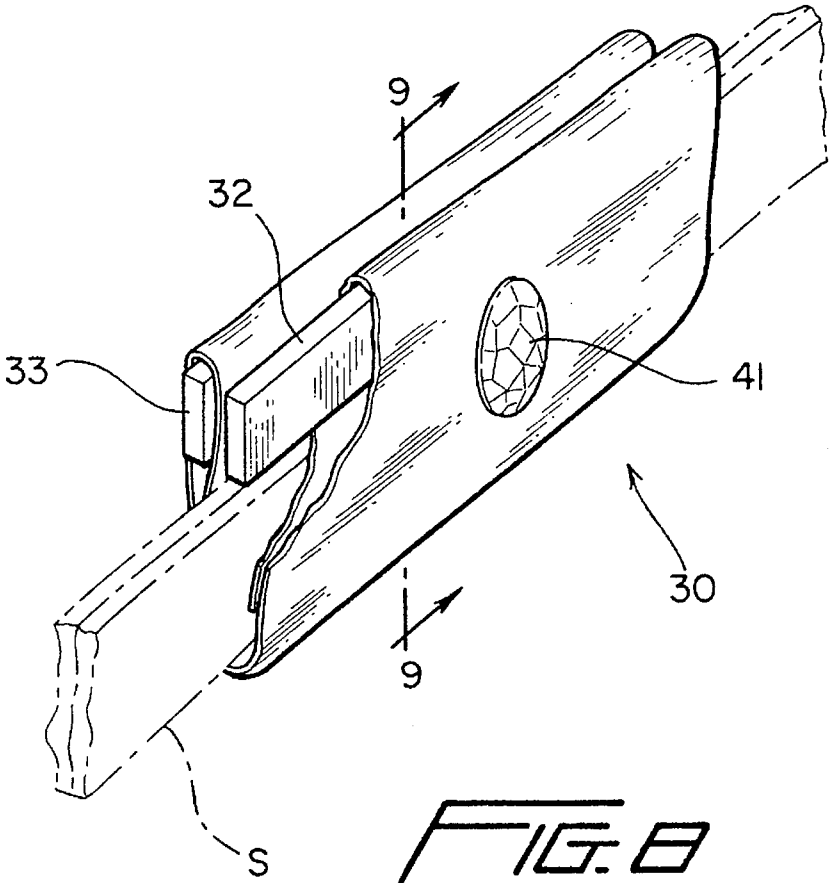
FIG. 8 is an enlarged perspective view of a modified cover according to the invention, wherein permanent magnets are inserted into the looped ends to hold the cover in place, with portions broken away for purpose of clarity.

A modification of the invention is indicated generally at 30 in FIGS. 8 and 9. In this form of the invention, the spring clips are replaced with elongate bars 32 and 33 of magnetic material. The magnets 32 and 33 may be permanently secured in the looped ends, as by stitching or the like, or they may be left separate and inserted into the looped ends similarly to the spring clips in the previously described form of the invention. If the magnets are permanently attached to the cover, it is necessary simply to place the looped ends about the straps, with the magnets in proximity with one another, and the cover will remain in place. To remove the cover, the wearer simply grasps the looped ends and pulls them away from one another.

Further, a barrette type clip (not shown) may be used to secure the looped ends together. With this form of the invention, the fastener would be inserted into the looped ends from only one end thereof, and following installation would appear much the same as the spring clips previously described.

If desired, suitable indicia, such as promotional material or advertising or the like 40 (see FIG. 2) may be provided on the front panel 16. Alternatively, jewelry or other decorative means 41 (see FIG. 8) may be provide on the front panel. Advertising material or other desired indicia could also be placed on the back panel, whereby the cover could be reversed, if desired, or the indicia could be placed on any of the other panels for selectively displaying multiple messages.

Although the invention has been illustrated and described in detail herein, it is to be understood that various changes and modifications may be made therein without departing from the spirit and scope of the invention as defined in the appended claims.

What is claimed is:

1. A decorative cap strap cover for concealing the adjusting straps on a cap, comprising:

a flat sheet of material folded to form looped ends defining elongate openings and generally parallel front and back panels, said sheet of material being foldable about the adjusting straps to substantially conceal the adjusting straps, with said looped ends disposed contiguous to one another so that the elongate openings extend parallel to the adjusting straps and the front and back panels lie on opposite sides of the adjusting straps; and elongate fastening means inserted lengthwise into the openings defined by said looped ends to hold the looped ends contiguous to one another and secure the sheet of material in folded relationship about said adjusting straps.

2. A cover as claimed in claim 1, wherein:

said looped ends are defined by folding opposite sides of the sheet of material inwardly upon themselves to approximately a midportion of the sheet, and the sheet is then folded about its midportion to bring the looped ends into proximity with one another.

3. A cover as claimed in claim 2, wherein:

said fastening means comprises a pair of generally bobby-pin-shaped spring clips which are inserted lengthwise into said elongate openings from opposite ends thereof, thereby securing the looped ends together to retain the cover in place on the adjusting straps.

4. A cover as claimed in claim 3, wherein:

decorative means are provided on the spring clips, said decorative means also functioning as gripping means which may be grasped to pull the spring clips from the looped ends to enable the cover to be removed from the adjusting straps.

5. A cover as claimed in claim 2, wherein:

said front panel defines a substantially flat surface on which indicia may be placed for advertising or promotional purposes and the like.

6. A cover as claimed in claim 5, wherein:

said fastening means comprises a pair of generally bobby-pin-shaped spring clips which are inserted into said looped ends from opposite sides, thereby securing the looped ends together to retain the cover in place on the adjusting straps; and decorative means are provided on the spring clips, said decorative means also functioning as gripping means which may be grasped to pull the spring clips from the looped ends to enable the cover to be removed from the adjusting straps.

7. A cover as claimed in claim 2, wherein:

said fastening means comprises a pair of magnets received in the looped ends for cooperation with one another to hold the looped ends together and retain the cover in place about the adjusting straps.

8. A cover as claimed in claim 2, wherein:

the sheet of material is made of leather.

9. A cover as claimed in claim 8, wherein:

advertising material is imprinted on the front panel.

10. A cover as claimed in claim 8, wherein:

an item of jewelry is carried on the front panel.

11. A decorative cover for concealing the adjusting straps on a cap, comprising:

a flat sheet of material folded to form looped ends and generally parallel from and back panels, said sheet of material being foldable about the adjusting straps to substantially conceal the adjusting straps, with said looped ends disposed contiguous to one another and the front and back panels lying on opposite sides of the adjusting straps, said looped ends defined by folding opposite sides of the sheet of material inwardly upon themselves to approximately a midportion of the sheet, and then folding the sheet about its midportion to bring the looped ends into proximity with one another; and fastening means received in said looped ends for securing the sheet of material in folded relationship about said adjusting straps, said fastening means comprising a pair of generally bobby-pin-shaped spring clips inserted into said looped ends from opposite sides, thereby securing the looped ends together to retain the cover in place on the adjusting straps.

12. A decorative cover for concealing the adjusting straps on a cap, comprising: a flat sheet of material folded to form looped ends and generally parallel front and back panels, said sheet of material being foldable about the adjusting straps to substantially conceal the adjusting straps, with said looped ends disposed contiguous to one another and the front and back panels lying on opposite sides of the adjusting straps said looped ends defined by folding opposite sides of the sheet of material inwardly upon themselves to approximately a mid-portion of the sheet, and then folding the sheet about its midportion to bring the looped ends into proximity with one another, and said front panel defining a substantially flat surface on which indicia may be placed for advertising or promotional purposes and the like;

fastening means received in said looped ends for securing the sheet of material in folded relationship about said adjusting straps, said fastening means comprising a pair of generally bobby-pin-shaped spring clips inserted into said looped ends from opposite sides, thereby securing the looped ends together to retain the cover in place on the adjusting straps; and decorative means on the spring clips, said decorative means also functioning as gripping means which may be grasped to pull the spring clips from the looped ends to enable the cover to be removed from the adjusting straps.

13. A cap having size adjusting strap means at its back, and a cover wrapped around at least a substantial portion of the adjusting strap means for obscuring at least a substantial portion of the adjusting strap means and for making the cap more comfortable to wear, wherein the cap strap cover comprises:

a flat sheet of material folded to form looped ends defining elongate openings and generally parallel front and back panels, said sheet of material being foldable about the adjusting strap means to substantially conceal the adjusting strap means, with said looped ends disposed contiguous to one another so that the elongate openings extend parallel to the adjusting strap means and the front and back panels lie on opposite sides of the adjusting strap means; and fastening means associated with the looped ends for holding them contiguous to one another and secure the sheet of material in folded relationship about the adjusting strap means.

* * * * *